United States Patent [19]

Whigham

[11] 3,957,482

[45] May 18, 1976

[54] REDUCTION OF METAL OXIDE MATERIALS

[76] Inventor: William Whigham, 200 de Gaspe, Apt. 1417, Nuns'Island, Quebec, Canada

[22] Filed: Nov. 4, 1974

[21] Appl. No.: 520,877

Related U.S. Application Data

[63] Continuation-in-part of Ser. No. 320,891, Jan. 4, 1973, abandoned.

[30] Foreign Application Priority Data

Jan. 12, 1972 United Kingdom ..... 1378/72

[52] U.S. Cl. ..... 75/.5 BA; 75/34

[51] Int. Cl.[2] ..... B22F 9/00

[58] Field of Search ..... 75/3, 5, 34, .5 BA

[56] References Cited

UNITED STATES PATENTS

| | | | |
|---|---|---|---|
| 2,306,665 | 12/1942 | Schwarzkopf | 75/34 X |
| 2,582,386 | 1/1952 | Komarek et al. | 75/3 |
| 2,833,642 | 5/1958 | Barker | 75/3 |
| 2,912,320 | 11/1959 | Chang | 75/34 |
| 2,989,395 | 6/1961 | Meyer | 75/5 |
| 3,154,403 | 11/1964 | Stickley et al. | 75/3 |
| 3,214,264 | 10/1965 | von Bogdandy | 75/34 X |
| 3,332,770 | 7/1967 | Wendt, Jr. et al. | 75/34 X |
| 3,419,383 | 12/1968 | Hatcher et al. | 75/34 X |

FOREIGN PATENTS OR APPLICATIONS

| | | | |
|---|---|---|---|
| 364,699 | 1/1932 | United Kingdom | 75/34 |

*Primary Examiner*—M. J. Andrews

*Attorney, Agent, or Firm*—Ian Fincham; Stanley D. Schwartz

[57] ABSTRACT

In the production of iron powder from iron oxide, normally it is difficult and costly to obtain complete reduction by conventional techniques; the present process provides an improvement whereby iron oxide powder is coated with an additive capable of liberating elemental carbon under the reducing conditions encountered in a furnace enabling the iron oxide powder to be supported on a perforated belt whereafter the same is passed through a furnace or the like so that the reducing gases can penetrate into the mass supported on the belt and the inert gases produced by the reaction can escape through the perforations in the belt.

18 Claims, No Drawings

REDUCTION OF METAL OXIDE MATERIALS

This application is a continuation-in-part of my copending U.S. patent application Ser. No. 320,891, filed Jan. 4, 1973, now abandoned.

This invention relates to the reduction of metal oxides to produce metal powders.

More particularly, this invention relates to the reduction of powdered oxides of metals, such as iron oxide in belt type reduction furnaces.

Inasmuch as the present invention has particular application to the reduction of powdered iron oxide, it will be described with reference thereto. It is to be understood, however, that other metallic oxides may be used in accordance with the teachings of the present invention.

The reduction of iron oxide to the metallic form in belt furnaces is known in the art. Reference may be had to the literature insofar as the basic processes involved are concerned. Briefly summarized, a belt furnace type of reduction of iron oxide powders involves the use of an elongated chamber heated by suitable means, and includes an endless movable belt rotating about suitable means, passing through the furnace. Hydrogen (a reducing gas) or mixtures of reducing gases containing hydrogen, are introduced into the furnace and the gaseous products of the reduction reaction are subsequently exhausted. Iron oxide to be reduced is charged onto the endless belt at one end of the furnace, and the reduced iron is taken off the belt at the opposite end.

This process, as aforementioned, is well known in the art, and in this respect, reference may be had to British Patent No. 364,699 issued Jan. 14, 1932 to Oberhausen which shows a process wherein lumps of ore are placed on a travelling grate conveyor through a stream of heated reduction gases. This patent provides hot gas which is drawn downward by suction means through the lumps or chunks of ore placed on the travelling conveyor means.

U.S. Pat. No. 3,214,264 issued Oct. 26, 1965 to L. von Bogdandy is typical of more recent developments relating to the treatment of metal oxides. This patent is directed to a process for sintering metallic oxides and utilizes a powder or fine-grained metallic oxide and converts the same to the metallic form. Basically, the process disclosed therein involves forming pellets and treating the same while being carried on a conveyor means. Processes useful in conjunction with the formation of pellets are disclosed in such references as U.S. Pat. Nos. 2,582,386; 2,833,642 and 3,154,403. Generally, these processes relating to the formation of ore pellets employ a clay binder such as bentonite.

While the above processes produce metals satisfactory for use as blast furnace feed wherein the product is molten iron and the clay is removed as a slag, they are not suitable for the production of iron powder wherein an admixture of inorganic impurities such as the bentonite clay cannot be tolerated. The separation of the bentonite clay from the reduced iron powder product is very difficult since some of the clay adheres to the metallic particles.

Furthermore, in the production of a metallic powder such as iron powder, the above processes involve pelletizing the ore for treatment of the same which necessitates subsequent grinding of the pellets to form the iron powder. Also, in grinding, the metal particles tend partially to re-oxidize during the operation.

As may be seen from the above, it would be highly advantageous to have a method for reducing powdered metal oxides, such as iron oxide, without pelletizing the powdered oxides and then subsequently grinding the reduced pellets.

As may be seen from the teachings of some of the above references, the endless belts of belt furnaces employed in the reduction of metal oxides may be permeable to the gases in the furnace when the metal oxide is in the form of pellets or chunks. However, for reducing powdered metal oxides, normally solid sheets of steel are employed which are nonpermeable to be the gases in the furnaces for the obvious reason that the belts carry very finely divided material as opposed to the lumps or chunks referred to in prior art. This raises the additional difficulty that the oxide bed on the belt is not readily penetrated by the reducing gas because the gaseous products of the reduction, mainly steam, do not readily diffise through and escape from the sides of the oxide layer, and diffusion downwards is prevented by the impermeable belt. Consequently, the time taken for the reduction to be completed is extended, and frequently the degree of reduction is not satisfactory.

Applicant has now found, in accordance with this invention, that the prior art difficulties may be readily overcome and that with the process of the present invention, improved yields of high quality metal powders — e.g. metallic iron powders, can be obtained.

More particularly, in accordance with this invention, the applicant has found in carrying out reduction of powdered metal oxides that if the starting material to be reduced is formed into a cohesive layer without introducing harmful contaminants or impurities, which when applied onto a belt perforated with small closely-spaced apertures does not flow through the said apertures then the disadvantages of the prior art may be substantially reduced in that the heavy inert gases produced during reduction escape readily through the perforations in the belt, thus facilitating the continuous penetration of the oxide layer by hydrogen or reducing gas.

In one embodiment of the present invention, the iron oxide starting material to be reduced is formed into a cohesive layer or cake of the same, which layer or cake of the same undergoes the formation of additional internal void space under reducing conditions, to permit an increased rate of penetration of the reducing gas therethrough. In this embodiment, the iron oxide starting material is preferably formed into a cake or layer of the same according to procedures described hereinafter; in such a case, the cake or layer of the starting material initially formed may not have sufficient strength or cohesiveness to be completely self-sustaining or -supporting, but once the cake or layer is introduced into a reduction furnace, the effects of heat render the cake or layer cohesive and self-supporting to withstand the reducing conditions and to permit the surfaces of the cake or layer to be subjected to the action of the reducing atmosphere without reverting into small particles which may fall through the belt perforations and be lost to the process. In such an embodiment where the initial formation of the cake or layer does not have sufficient strength to be self-supporting, the cake may be fed to the reducing furnace while being supported, following which the non-self-supporting cake may be rendered self-supporting due to the conditions existing in the reduction furnace to provide a self-supporting cake or layer with an increased void space which may then be reduced in the above-described manner.

A practical form of the present invention, involves reducing the starting material in a belt furnace in which is provided a perforated belt capable of transporting the iron oxide material through the furnace. To this end, various types of perforated belts may be employed — for example, perforated or apertured sheet material is preferably used to form the belt; alternately, woven or mesh type belts may also be employed. In these instances, and with any other type of belt employed, it is essential that its porosity be very high to permit the gravity flow of the spent gases, which are denser than the reducing gas, through the oxide layer and through the belt so that the oxide particles are constantly exposed to the reducing action of fresh dry reducing gas. By way of typical examples, perforated belts of suitable material may have apertures ranging up to ½ inch or more, but preferably about ¼ inch, with adjacent apertures being spaced approximately ½ inch (this may be more or less, as desired) from each other. In the case of mesh, since the material being reduced is self-supporting, there is no criticality in the configuration of the wires forming the mesh with the exception that the mesh must of course be strong enough to transport the material through the furnace. In general, it may be stated that the type of belt employed should have porosity such that it permits the reducing atmosphere to come into contact with the maximum surface area of the material being reduced and also permits the ready escape of the inert gases formed during reduction.

As above mentioned, where the material to be reduced is in the form of a cake or layer, and should the cake or layer as originally formed (prior to the material actually being subjected to reduction) not possess sufficient strength to be completely self-supporting prior to being reduced, it may be appropriate to utilize a more closely woven belt (but one which will have the above-defined characteristics with regard to permeability) to permit the cake or layer to be transported to the reduction furnace. Of course, when the cake or layer as initially formed is in a self-supporting form, then the fineness of the mesh or aperture size is of less concern.

As used in this specification, the term "self-supporting" in describing the cake or layer, is intended to denote that the material is generally in a form such that it has sufficient cohesiveness or stability to permit handling and is capable of withstanding the conditions encountered, during reduction, without disintegrating into small particles which might flow through the apertures in the belt and be lost. Thus, as explained thereinbefore, the iron oxide starting material must initially be formed into a cake or layer, which in the "as-formed" stage, is capable of withstanding the conditions encountered during the reduction and in being transported through the reduction furnace.

The development of the present invention, by utilizing cohesive material during the reduction, has been found to provide advantages in iron oxide reduction processes, in that when combined with the other steps of applicant's process — permitting the maximum area of the material to be exposed to a reducing gas and by employing a perforated belt, substantially complete reduction in relatively short periods of time can be obtained, in contrast to which, prior art procedures require anywhere from two to several times the amount of time to obtain reduction. Thus, the process of the present invention provides a more economical procedure for obtaining iron powder.

In carrying out the above process, the thickness of the iron oxide cake or layer may vary considerably. Generally speaking, the thickness of the bed may be anywhere from 0.5 to 3.0 inches.

In accordance with the above, there is provided a process for obtaining a cake or layer suitable for use in the above-described process, in which the substance or substances used to form the oxide into a cohesive form liberates elemental carbon at the temperatures encountered during reduction so that during the time when the oxide is exposed to reducing conditions the reduction is facilitated by the carbon dispersed through the oxide, the said carbon reacting with part of the oxygen content of the ore to form gaseous carbon monoxide and dioxide, and thus supplies a proportion of the total reductant requirement for the process.

An alternative form of this further development also includes the embodiment wherein there is provided the steps of providing a suitable carbon yielding additive which when applied in a wet form to the oxide assumes a soapy or gelatinous form in which gas bubbles are readily trapped, and providing in combination an agent which decomposes readily as its temperature is increased to yield a gaseous degradation product, and introducing the combination additive into contact with the iron oxide in the belt furnace where the said decomposable substance liberates gas which tends to be trapped as bubbles by the carbon additive. In this way the oxide particles tend to assume the form of a very porous bed which assists the movement of gases through the bed and as the aqueous component evaporates and the carbon additive decomposes the oxide layer stabilizes in a porous form with the liberated carbon acting as a binding agent which prevents the porous bed from collapsing and also prevents loss of oxide particles through the perforations on the belt. It will be understood by those skilled in the art that although the carbonaceous binding material is consumed during the reduction reaction the oxide particles are simultaneously assuming the metallic form. At the reduction temperatures the metallized particles tend to adhere to each other so that the porous structure of the partially reduced bed is maintained after the binding agent has been consumed. In this manner the depth of the oxide layer inside the furnace may become as much as twice the depth of the oxide at the point of application onto the belt, so that the void space is increased accordingly and the permeability of the bed to gases thereby increased.

Various types of carbon yielding additives may be employed, such as, for example, starch, wheat flour, etc. Other additives may be employed in a similar manner, such additives having the requirement that they are capable of being degraded to form carbon at the temperatures encountered during the reduction reaction. The particular additive chosen should be free from harmful impurities, readily available and economical for obvious reasons. The further additive capable of being decomposed to form a gaseous degradation product at the temperatures encountered during the reaction may be any suitable substance having these attributes. Typical of such substances, are, for example, urea, etc. Such gaseous forming additives as those just mentioned are either non-reactive, or in the alternative, may possess reducing characteristics. Thus the gas-forming additive may also provide a portion of the total reducing agent requirements for the process.

The amount of carbon yielding additive and gaseous forming decomposable additive employed in the process of the present invention may vary within wide limits; however, it is most desirable to employ only the amount necessary to provide the desired characteristics. Thus, it has been found that amounts as low as 0.3–0.5% by weight of the resulting carbon from a carbon yielding additive, based on the the weight of the iron oxide material and evenly distributed through the oxide as a slurry or solution, may provide satisfactory results. The gas-forming additive may also be employed in a similar amount.

The carbon forming additive, such as starch or wheat flour, may be dispersed in a liquid medium, e.g. water and applied to the iron oxide powder in the form of a precoating on the powder particles. In the case of the carbon yielding additive being combined with the gas-forming additive, the combination is first formulated in a solution or dispersion, and then added to the material.

In the case of precoating the starting material, the additive(s) may be initially dispersed in a suitable inert liquid which is then applied to the iron oxide powder, the precoated powder being loaded onto the belt and the carrier then being permitted to evaporate. Thereafter, the iron oxide powder may then be fed to the belt furnace. Thus, there is fed into a furnace a product which during the reduction stages, will be self-supporting. On the other hand, where it is desired to use this further development in a slightly different form, the additive(s) may be sprayed onto the iron oxide layer as it enters the belt furnace, using any suitable inert carrier. Where solutions of the additive(s) are employed, such as for application of the additive in a spray form for use in the belt furnace, the solution is preferably viscous. When the viscous solution is employed as a spray in the belt furnace, the carbohydrate additive when employed in combination with the gaseous liberating additive, is preferably one which has the properties of forming a viscous syrupy solution capable of entrapping gas bubbles.

The iron oxide powder starting material which may be used, in the above-described first development, or in this second development may be any suitable iron oxide material capable of being reduced in a belt furnace to yield a desired product. In this respect, it suffices to say that those skilled in the art will readily understand the various types of iron oxide materials, for example, millscale and specular hematite, which may be employed. Likewise, the oxide material is preferably in a finely ground particulate form substantially free from any harmful or deleterious impurities prior to being reduced in the belt furnace. The particular particle size may be selected by those skilled in the art, likewise, those skilled in the art will readily understand the various procedures involved with further purification of the iron oxide starting material.

The reduction temperatures of the belt furnace are well understood by those skilled in the art and may be employed in the present invention. Likewise, all conventional expedients associated with the reduction of iron oxide material using hydrogen reducing gas may likewise be employed with the process of the present invention.

In accordance with a still further development, which may be incorporated with the teaching of the above described two embodiments, the iron oxide starting material may be reduced in two stages; the first stage involving the reduction of finely ground iron oxide powder to obtain only a partially reduced product, following which the reduction is completed by forming the partially reduced powder into a self-supporting form, and subjecting that self-supporting material to reducing conditions to complete the reduction.

In the initial or first stage of reduction means of reduction other than belt furnaces may be employed, and the degree of reduction of the iron oxide powder may vary depending on several factors, including for example, the type of equipment used, etc., and may be between about 60 to about 90% complete. Higher or lower degrees of reduction of the iron power may however take place if desired — it has been found that, in the case of first stage reduction in a fluid bed, the present development provides the most advantageous features when the degree of reduction in the initial stage is halted before the rate of the reduction reaction of the iron oxide falls off substantially and agglomerating of the iron powder particles begins to become a problem.

Following the initial or pre-reduction the partially reduced starting material may be formed into an agglomerated and cohesive form, according to the previously described procedures with or without the use of carbon-forming or other additives. It will be understood by those skilled in the art that the agglomeration of the partially reduced oxide by pressure alone, and without the use of a binding agent can only be employed when the pre-reduction of the oxide has proceeded sufficiently to cause at least the surfaces of the particles to assume a metallic form, since the compaction technique depends on the cold-welding characteristic of the fresh metallic surfaces. Oxide particles cannot be compacted into a self-supporting form by pressure alone. In this respect the agglomerated form of the partly reduced material, should preferably have a relatively low bulk density — i.e., the material should be porous, consistent with providing a self-supporting product having the desired degree of mechanical strength under the reducing conditions which are encountered.

For the sake of efficiency during the final reduction stage, the density or porosity of the layer is most desirably such that they are highly porous, with a porosity of at least 50% being preferred. In other words, on a volume basis, the partially reduced metal oxide preferably forms approximately one-half the volume, the other half being formed by the space between the particles.

The present two-stage reduction procedure of this further development is particularly suitable for use in the above-described embodiment where a self-supporting cake or layer is reduced on a porous belt in a belt furnace — utilizing the development described above wherein it is disclosed that an organic material such as a carbohydrate capable of being degraded at temperature encountered during the reduction reaction, to yield carbon, may be incorporated into the products.

In the above described procedures, reference has been made to the use of substantially pure iron oxide as a starting material. However, the various embodiments of the present invention may also be used with other materials. A specific example would be the use of the various embodiments of these developments for the upgrading of ilmenite ore containing FeO and $TiO_2$, to yield synthetic rutile ore (consisting of substantially $TiO_2$). Thus, the iron oxide of the starting material may be converted to metallic form using the above described embodiments, and separated (e.g. leached) from the treated starting material to provide an upgraded titanium ore.

As an example of the improved yields of iron powder obtained with the process of the present invention, a belt furnace which operated with an unperforated sheet metal belt, carrying finely ground iron oxide into which no additives had been introduced had a productive capacity of about five tons per day or iron powder product with a typical residual oxygen content after reduction of about 0.5% by weight.

Upon the installation of a belt perforated in accordance with the teachings of one embodiment of this invention, and with the oxide feed to the process converted to a cohesive form by the addition of one percent of starch, calculated on the dry weight of the oxide, in the form of an aqueous solution or dispersion, it was found that a production rate in excess of 15 tons of iron powder product per 24-hour day, with a residual oxygen content of about 0.3% by weight could be maintained on a continuous basis. In other words, by following the teachings of this invention the capacity of the process was increased by about two hundred percent, and the quality of the product, with respect to completeness of reduction, also improved significantly.

As may be seen from the above description, the process of the present invention provides a method of reducing powder metal oxides without forming the same into pellets thus obviating this operation as well as the step of grinding the reduced pellets. Furthermore, no inorganic impurities are added to the powdered metal oxides which would later present a problem in their removal. It will furthermore be noted that the process of the invention does not require the use of suction equipment which has been proposed in various prior art relating to the sintering of ores or metals.

The novel process of the present invention preferably employs the above-described perforated belt wherein the interstices are very small. The use of a starch binder imparts sufficient strength to the oxide layer on the belt that the use of the aforementioned impurities such as bentonite clay is avoided.

I claim:

1. In a method of forming iron powder by reducing finely divided iron oxide powder using a gaseous reducing agent in which hydrogen is a major component, in a heated furnace wherein said oxide is reduced in said furnace by passing the same through said furnace so that said oxide is substantially reduced to the metallic form by reacting with the reducing gas to form steam and/or carbon monoxide and/or carbon dioxide gases all of which are denser than said reducing gas, the improvement comprising the steps of coating the iron oxide powder with an additive capable of liberating elemental carbon under the reducing conditions encountered in said furnace, forming a self-supporting layer of said finely divided iron oxide powder in the form of a layer or cake of the same on a perforated movable supporting means on which said finely divided iron oxide powder may be supported without substantial loss of said powder through said perforated supporting means, and passing said iron oxide powder on said supporting means through said furnace and exposing the same to said gaseous reducing agents in said furnace, permitting the steam, carbon monoxide and carbon dioxide to penetrate through said supporting means by gravity flow and thereby permit continuous penetration of said oxide layer or cake by gaseous reducing agents, said layer of finely divided iron oxide powder being a cohesive self-supporting layer or cake under the reducing conditions encountered in said furnace, and when said layer or cake is initially formed on said supporting means, said layer or cake being non-self-supporting.

2. A method, as defined in claim 1, wherein said movable supporting means comprises a gas-permeable perforated belt movable through said furnace.

3. A method, as defined in claim 2, wherein said belt comprises a woven or mesh belt capable of sustaining the weight of said iron oxide powder.

4. A method, as defined in claim 3, wherein said belt has apertures of a size sufficient to permit penetration of reducing gases therethrough.

5. A method, as defined in claim 1, wherein said iron oxide layer comprises a layer of the same having a thickness of between 0.5 to about 3.0 inches on said movable supporting means.

6. A method, as defined in claim 1, wherein the step of coating the finely divided iron oxide powder with an additive capable of liberating elemental carbon comprises the step of spraying the finely divided iron oxide powder with said additive when the iron oxide powder is placed on said perforated supporting means.

7. A method, as defined in claim 1, wherein said source of finely divided iron oxide powder initially includes a first carbon yielding additive and a second additive, said carbon yielding additive being capable of assuming a soapy or gelatinous form in which gas bubbles are readily trapped and further being capable of yielding carbon under the reducing conditions in the furnace, said second additive being capable of decomposing under the reducing conditions of said furnace to yield gaseous decomposition products only.

8. A method, as defined in claim 7, wherein the carbon yielding or forming additive is a starch or wheat flour.

9. A method, as defined in claim 8, wherein said second additive is urea.

10. A method, as defined in claim 8, wherein the carbon yielding additive is present in an amount of from about 0.3 to about 0.5% by weight of the iron oxide material.

11. A method of forming powdered iron comprising the steps of:

a. providing a source of finely divided iron oxide powder, b. coating said iron oxide powder with a carbon-containing binding material dispersed in a liquid medium, c. forming a self-supporting layer of said iron oxide powder with said carbonaceous binding material on a perforated finely apertured movable conveyor belt, d. passing said belt containing said iron oxide powder through a heated furnace containing a gaseous reducing agent in which hydrogen is a major component, allowing steam, carbon monoxide and carbon dioxide formed within said layer to penetrate through said conveyor belt by gravity flow to permit continuous penetration of said layer by gaseous reducing agent, e. collecting the reduced material from said conveyor belt after said iron oxide powder has been reduced to iron with a residual oxygen content of no larger than 0.5% by weight.

12. A method, as defined in claim 11, wherein said belt has apertures of a size sufficient to permit penetration of reducing gases therethrough.

13. A method, as defined in claim 11, wherein said iron oxide layer comprises a layer of the same having a thickness of between 0.5 to about 3.0 inches on said movable supporting means.

14. A method, as defined in claim 11, wherein said source of finely divided iron oxide powder initially includes a first carbon yielding additive and a second additive, said carbon yielding additive being capable of forming a soapy or gelatinous form in which gas bubbles are readily trapped and further being capable of yielding carbon under the reducing conditions in the furnace, said second additive being capable of decomposing under the reducing conditions of said furnace to yield a gaseous degradation product.

15. A method, as defined in claim 14, wherein said second additive is urea.

16. A method, as defined in claim 11, wherein the carbon yielding additive is present in an amount of from about 0.3 to about 0.5% by weight of the iron oxide material.

17. A method of forming iron powder comprising the steps of:

a. supplying a source of finely divided iron oxide powder, b. partially reducing said iron oxide powder in an atmosphere containing a gaseous reducing agent of which hydrogen is a major component, said reduction being about 60% to about 90% complete, forming said partially metallized iron oxide into a cohesive form, such cohesive form having a bulk density substantially lower than the density of the particles comprising the cohesive form, c. placing said cohesive material on a movable apertured supporting belt and completing the reduction of said partially reduced material by exposing the same to gaseous reducing agents in a furnace, said complete reduction removing at least 95% by weight of the oxygen content of said original iron oxide powder.

18. A method, as defined in claim 17, wherein the step of forming said partially metallicized iron oxide into a cohesive form produces a cohesive form having a relatively low bulk density and having a porosity of at least 50%.

* * * * *